US005560184A

United States Patent [19]

Tisma

[11] Patent Number: 5,560,184

[45] Date of Patent: Oct. 1, 1996

[54] MEANS FOR AND METHODS OF LOADING AND PACKAGING VARIABLE NUMBERS OF PRODUCTS

[75] Inventor: Stevan Tisma, Elk Grove Village, Ill.

[73] Assignee: Tisma Machinery Corporation, Elk Grove Village, Ill.

[21] Appl. No.: 169,374

[22] Filed: Dec. 17, 1993

[51] Int. Cl.[6] ..... B65B 35/30

[52] U.S. Cl. ..... 53/531; 53/252; 53/257; 53/500; 53/501; 53/540

[58] Field of Search ..... 53/148, 251, 252, 53/255, 257, 260, 500, 531, 537, 540, 495, 498, 501

[56] References Cited

U.S. PATENT DOCUMENTS

| | | | |
|---|---|---|---|
| 2,106,975 | 2/1938 | Francis | 53/255 X |
| 2,442,250 | 5/1948 | Spain | 53/537 X |
| 2,661,103 | 12/1953 | Fay et al. | 53/500 X |
| 3,056,485 | 10/1962 | Liberty | 53/252 X |
| 3,155,221 | 11/1964 | Griner | 53/531 X |
| 3,216,173 | 11/1965 | Anderson | 53/251 X |
| 3,218,780 | 11/1965 | Kerr | 53/537 X |
| 3,267,641 | 8/1966 | Molins | 53/148 |
| 3,316,103 | 4/1967 | Scopelite et al. | 53/500 X |
| 3,473,289 | 10/1969 | Vadas | 53/537 X |
| 3,810,344 | 5/1974 | Evans et al. | 53/252 X |
| 3,854,270 | 12/1974 | Cloud et al. | 53/252 X |
| 3,881,298 | 5/1975 | Griner et al. | 53/537 |
| 3,902,587 | 9/1975 | Checcucci | 53/537 X |
| 4,174,029 | 11/1979 | Kawaguchi et al. | 53/148 X |
| 4,179,865 | 12/1979 | Pellaton | 53/252 X |
| 4,546,594 | 10/1985 | Mohaupt | 53/539 X |
| 4,590,743 | 5/1986 | Hardage | 53/542 X |
| 4,712,356 | 12/1987 | Hardage et al. | 53/542 X |
| 4,870,807 | 10/1989 | Palamides et al. | 53/540 X |
| 5,072,573 | 12/1991 | Tisma | 53/252 |
| 5,081,823 | 1/1992 | van der Ent | 53/540 X |
| 5,095,684 | 3/1992 | Walker et al. | 53/500 X |
| 5,170,610 | 12/1992 | Tisma | 53/260 X |
| 5,265,398 | 11/1993 | Van Alstine et al. | 53/500 X |

FOREIGN PATENT DOCUMENTS

| | | | |
|---|---|---|---|
| 0521428 | 1/1993 | European Pat. Off. | 53/540 |
| 2221450 | 4/1975 | France | 53/251 |
| 0098824 | 4/1991 | Japan | 53/531 |

*Primary Examiner*—Lowell A. Larson
*Assistant Examiner*—Daniel Moon
*Attorney, Agent, or Firm*—Laff, Whitesel, Conte & Saret, Ltd.

[57] ABSTRACT

A loader for an automatic packaging machine has a plurality of input conveyor belts that run at successively slower speeds in order to bring products into a predetermined product density. A metering wheel picks up the products one at a time and delivers them to a metering conveyor belt having upstanding fences defining batch areas. The profile of the metering wheel may be changed, by substitution, in order to pick up another product. A product counter moves the metering conveyor belt a distance equal to one batch area responsive to a batch count indicating that the metering wheel has delivered a selected number of products to one of the batch areas. In one embodiment, the product is a tube of soda crackers. Down stream, the soda crackers are slid into position without abrading one tube of crackers against another tube of crackers. For horizontal layers, abrasion is avoided by using a variable width mandrel. For vertical layers, a blade is positioned between layers during the positioning of one layer over a previously installed layer.

12 Claims, 11 Drawing Sheets

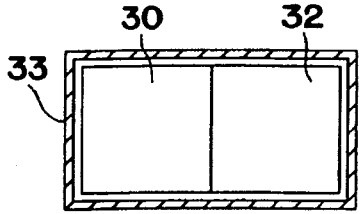
FIG. IA
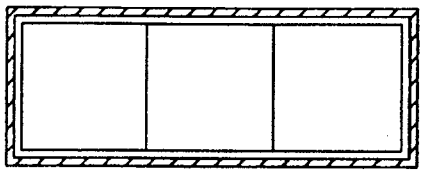
FIG. IC
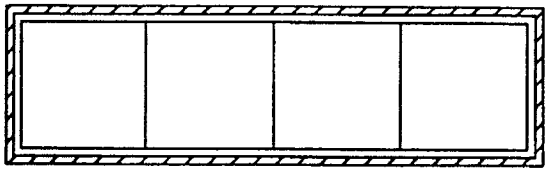
FIG. IE
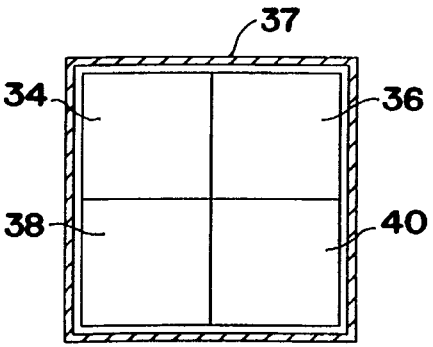
FIG. IB
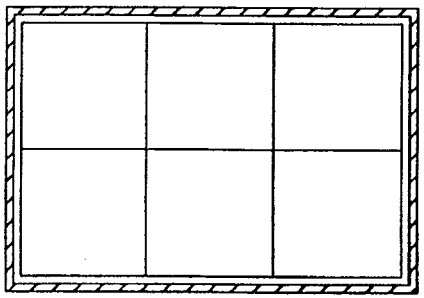
FIG. ID
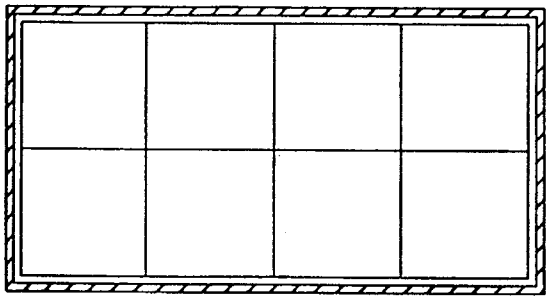
FIG. IF

MEANS FOR AND METHODS OF LOADING AND PACKAGING VARIABLE NUMBERS OF PRODUCTS

This invention relates to automatic packaging machines and more particularly to machines for packaging variable numbers of products, especially fragile products, in containers of different sizes.

In the automatic packaging field, the term "slug" or "slugs" is sometimes used to generically refer to an individual item or items which are sorted, transported and otherwise handled in order to assemble and package them. Some "slugs" are more fragile than others and, therefore, must be handled with great care.

A tube of soda crackers wrapped in wax paper is an example of such a fragile slug. Usually, the individual crackers are not perfectly aligned so that a few may stick out here and there as compared to the average position of most of the crackers in the tube. Therefore, as two side-by-side tubes of crackers are inserted into a box, they often scrape against each other. This and various other events tend to abrade the poorly aligned individual crackers. As a result, little pieces are broken off the crackers so that when the tube is opened, crumbs are likely to fall out and to be scattered, causing an annoyance to the consumer.

These crackers packed in wax paper tubes also illustrate another problem since the same kinds of tubes of crackers may be packaged in boxes of different size and shapes. Thus, for example, a small box may contain two and a large box may contain eight tubes of crackers. Some boxes may have all tubes arranged in a single layer. Other boxes may have the tubes arranged in two layers. As a second layer is inserted into the box, over a previously installed lower layer, there may be more chipping and abrading of the crackers.

Another a concern in an automatic packaging machine always, is the speed at which products are packaged. Therefore, all of the foregoing problems should be overcome while enabling the packaging machine to operate at still higher speeds.

Accordingly, an object of the invention is to provide new and improved automatic packaging machines, especially machines for metering and delivering product or "slugs" (such as tubes of soda crackers) which may be damaged by normal handling. In this connection, an object is to provide means for selecting any suitable number of slugs for loading into a box or other container. Here, an object is to load the slugs in any of many optional configurations.

A more specific object of the invention is to load boxes with tubes of soda crackers wrapped in wax paper or the like. Here, an object is to optionally load such tubes of crackers into selected boxes which may receive any number from two to eight tubes of crackers. In particularly, an object is to optionally fill boxes with tubes of crackers arranged in either one or two layers.

In keeping with an aspect of the invention, these and other objects are accomplished by a series of conveyor belts which run at progressively slower speeds in order to accumulate the slugs into a compact array with a desired product population density. A meter wheel after the end of the slowest conveyor belt picks up the slugs one at a time and deposits them on another and metering conveyor belt having fences periodically positioned thereon. The meter wheel lays a selected number of products or slugs on the other metering conveyor belt in a first area between each two adjacent fences. A counter causes the belt to move on and present a second and new fenced area after a selected number of slugs has been laid on the first area. This process is programmable so that any selected number of slugs are laid down on each of the areas.

The selected number of products or slugs are then conveyed from the first area to a carton or box. If two layers are to be inserted into a single box, a blade may be positioned over the first inserted layer while the second inserted layer is pushed into place over the first layer. Then, the blade is withdrawn. This way the second installed layer does not rub against and possibly abrade the previously installed first layer.

A preferred embodiment is shown in the attached drawings, in which:

FIGS. 1A–1F show six optional configurations, by way of example, which may be selected for packaging the slugs in any of a number of cartons or boxes;

Figure 3:
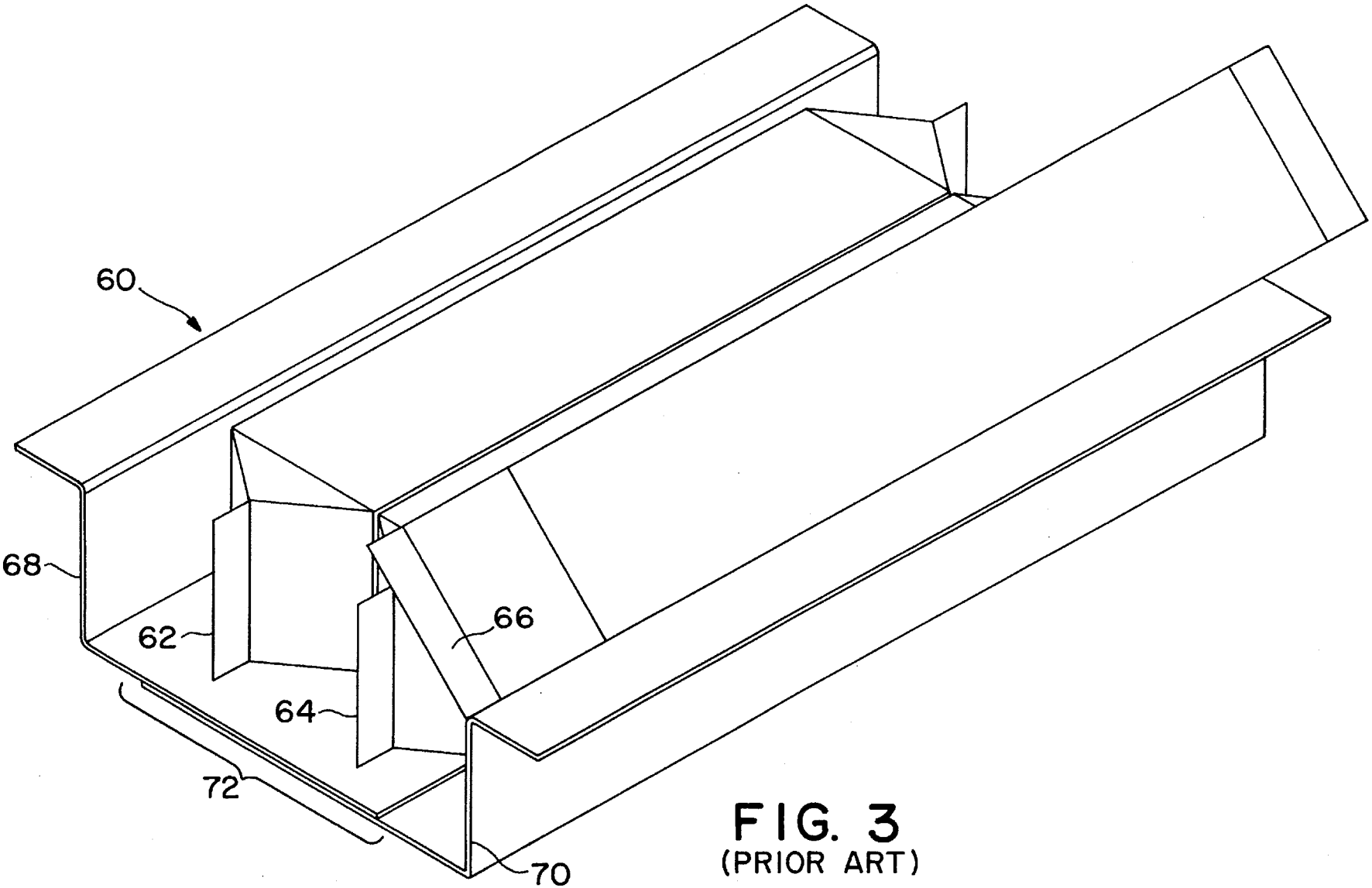
FIG. 3 (PRIOR ART)
Figure 4:
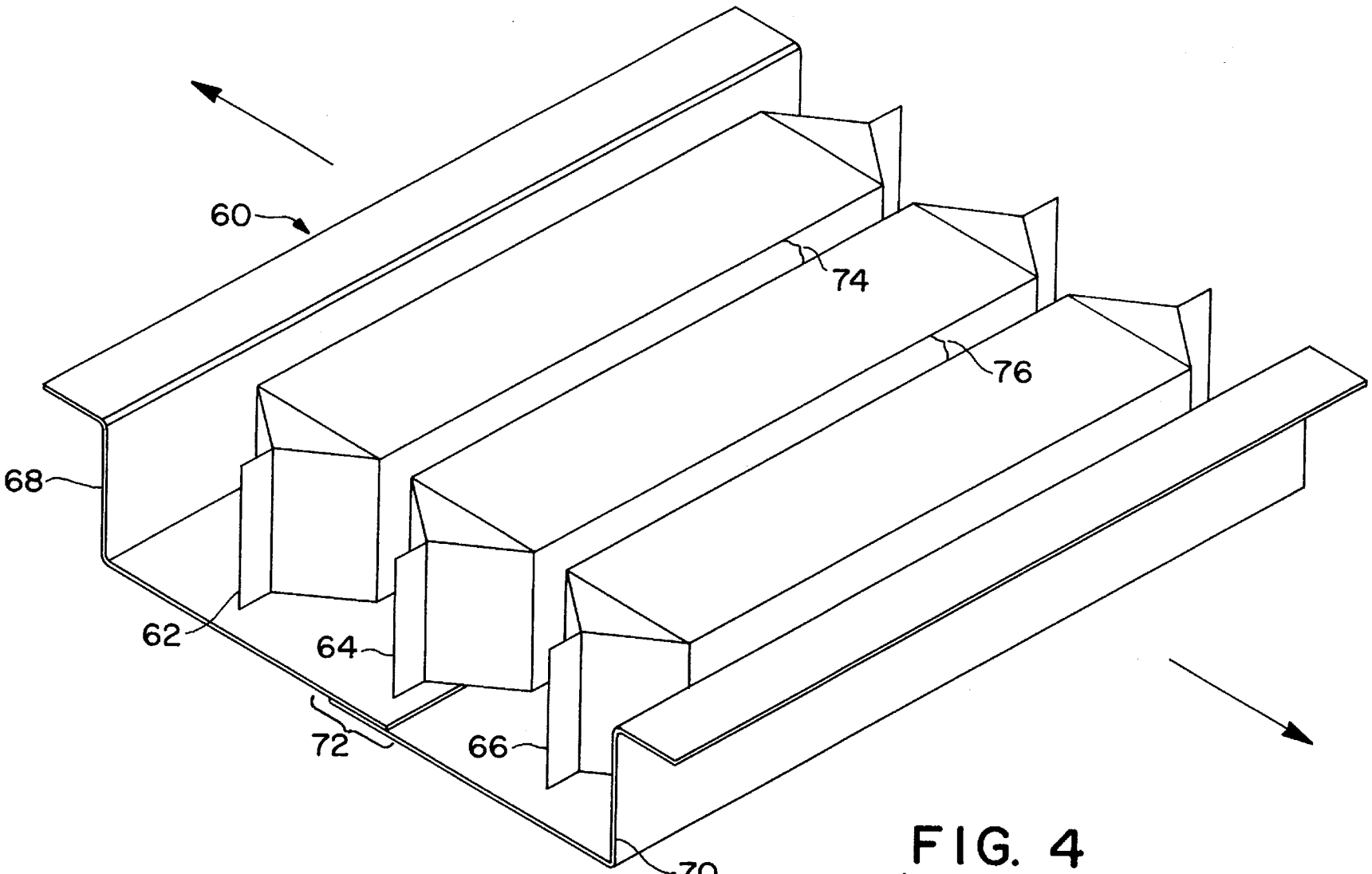
FIG. 4 (PRIOR ART)
Figures 5A, 6:
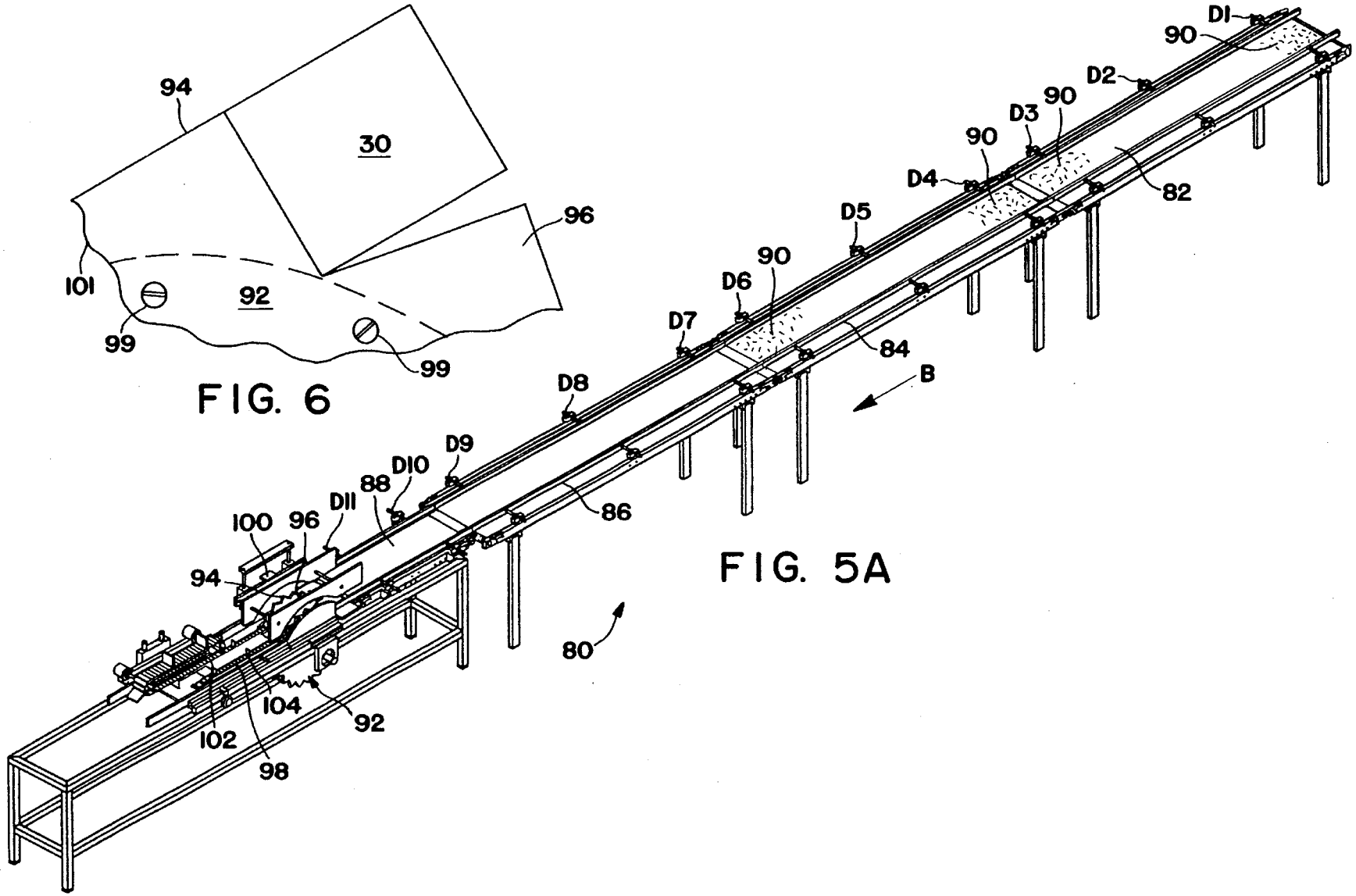
Figure 5B:
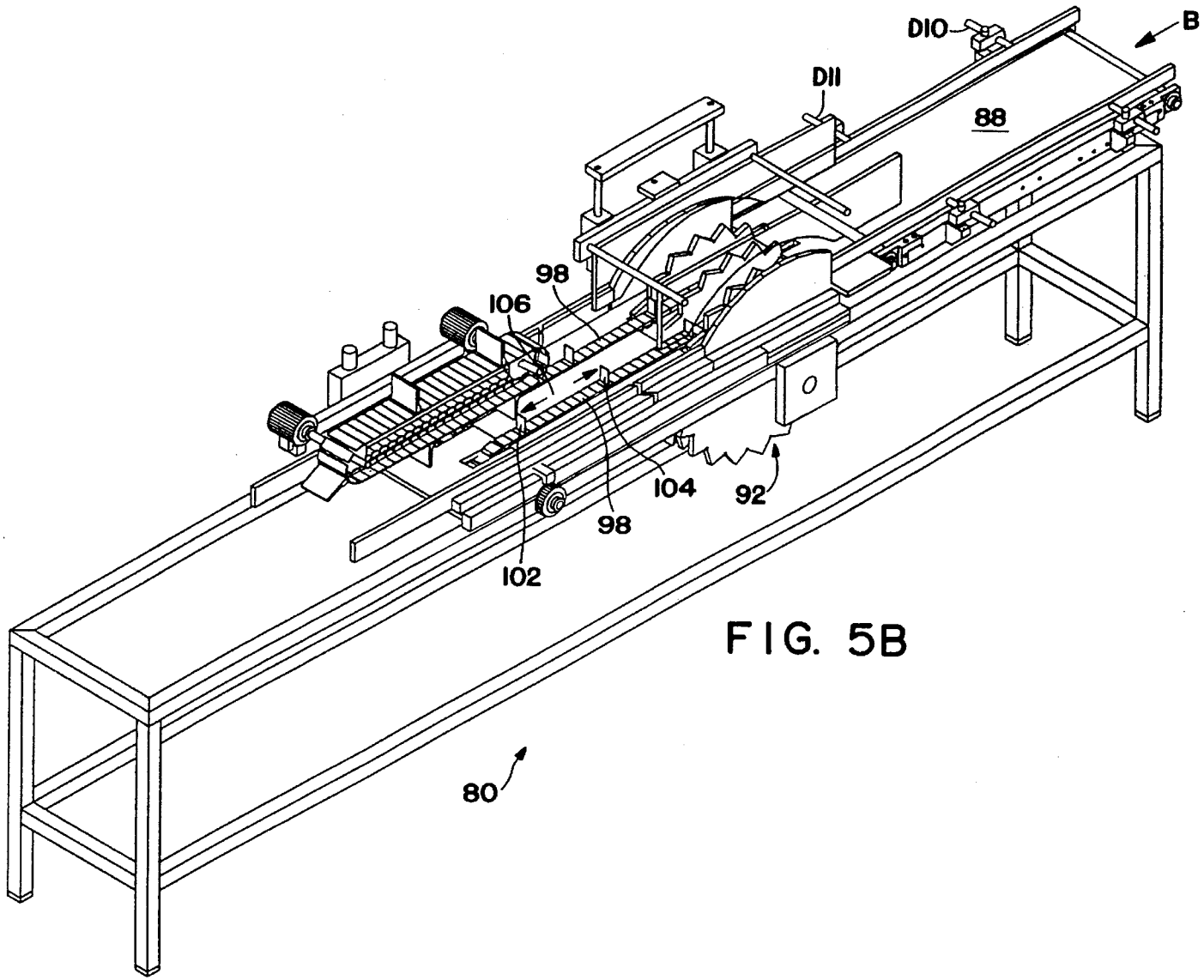
Figure 7:
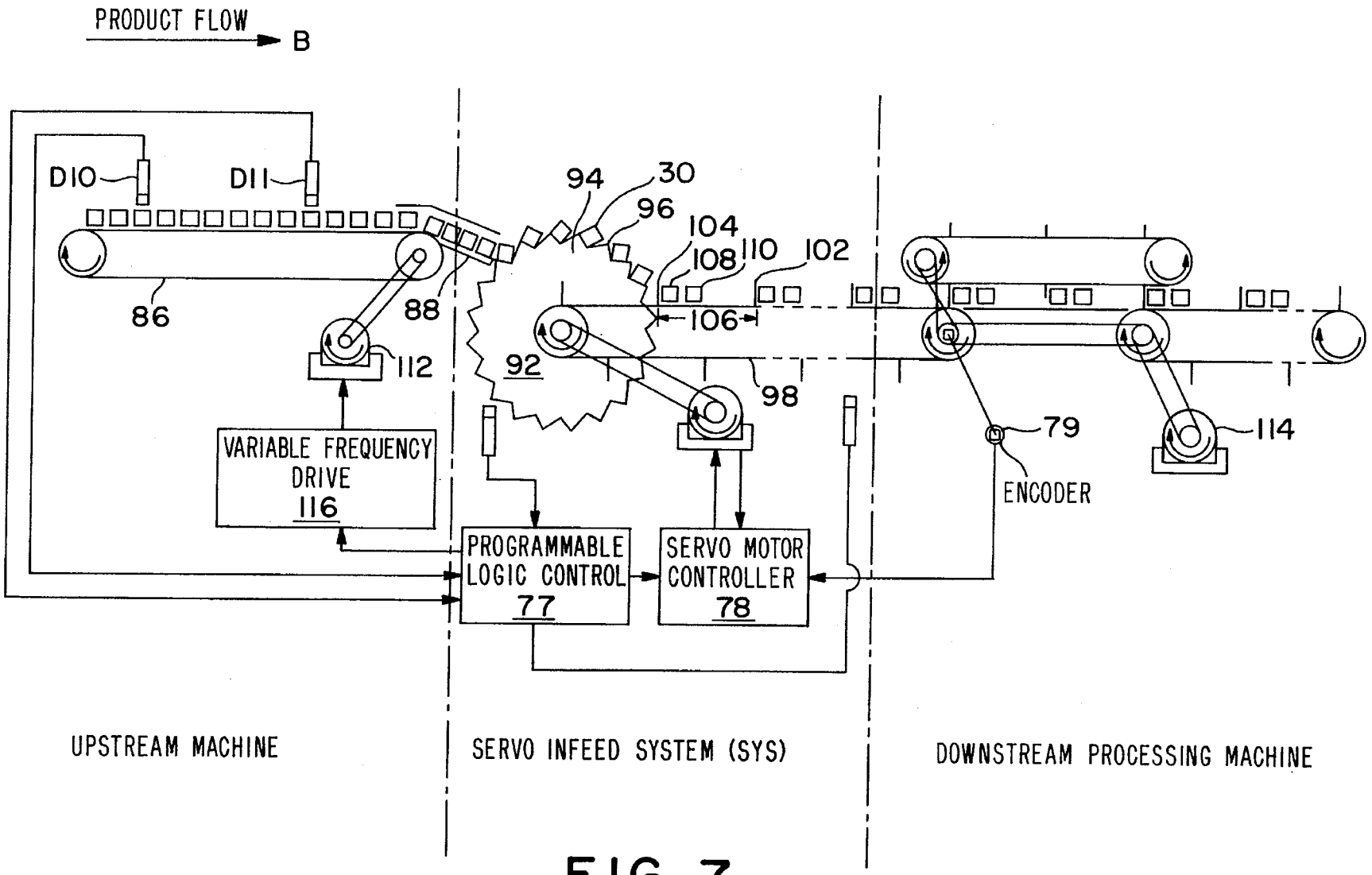
Figure 8:
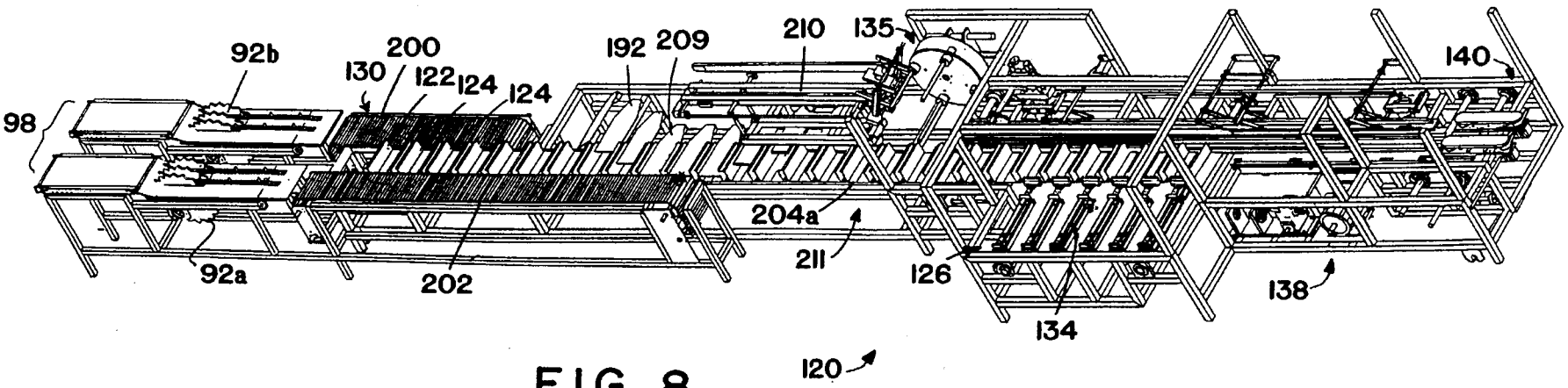
Figures 9, 9A:
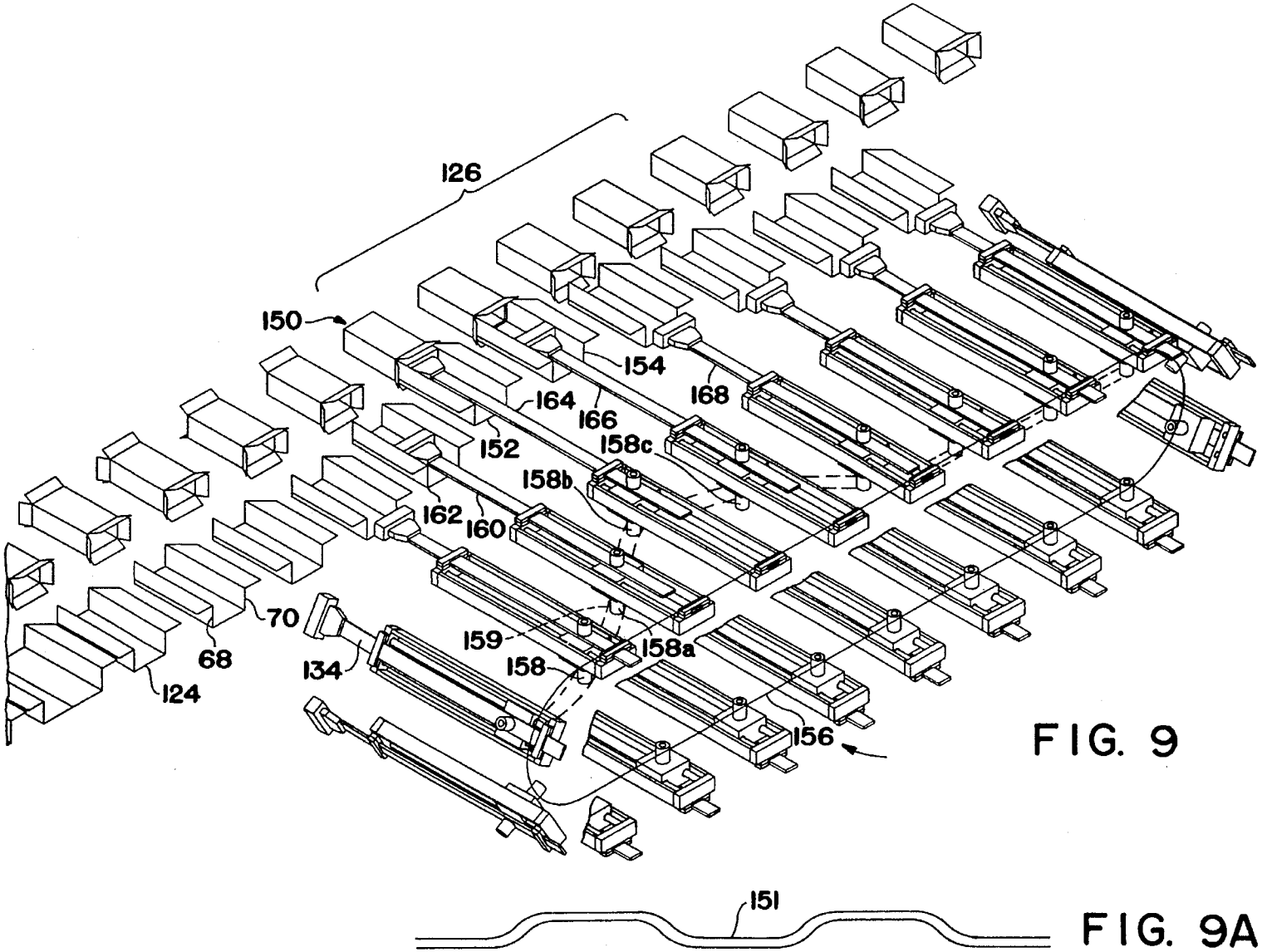
Figures 10A, 10B, 10C, 11, 12:
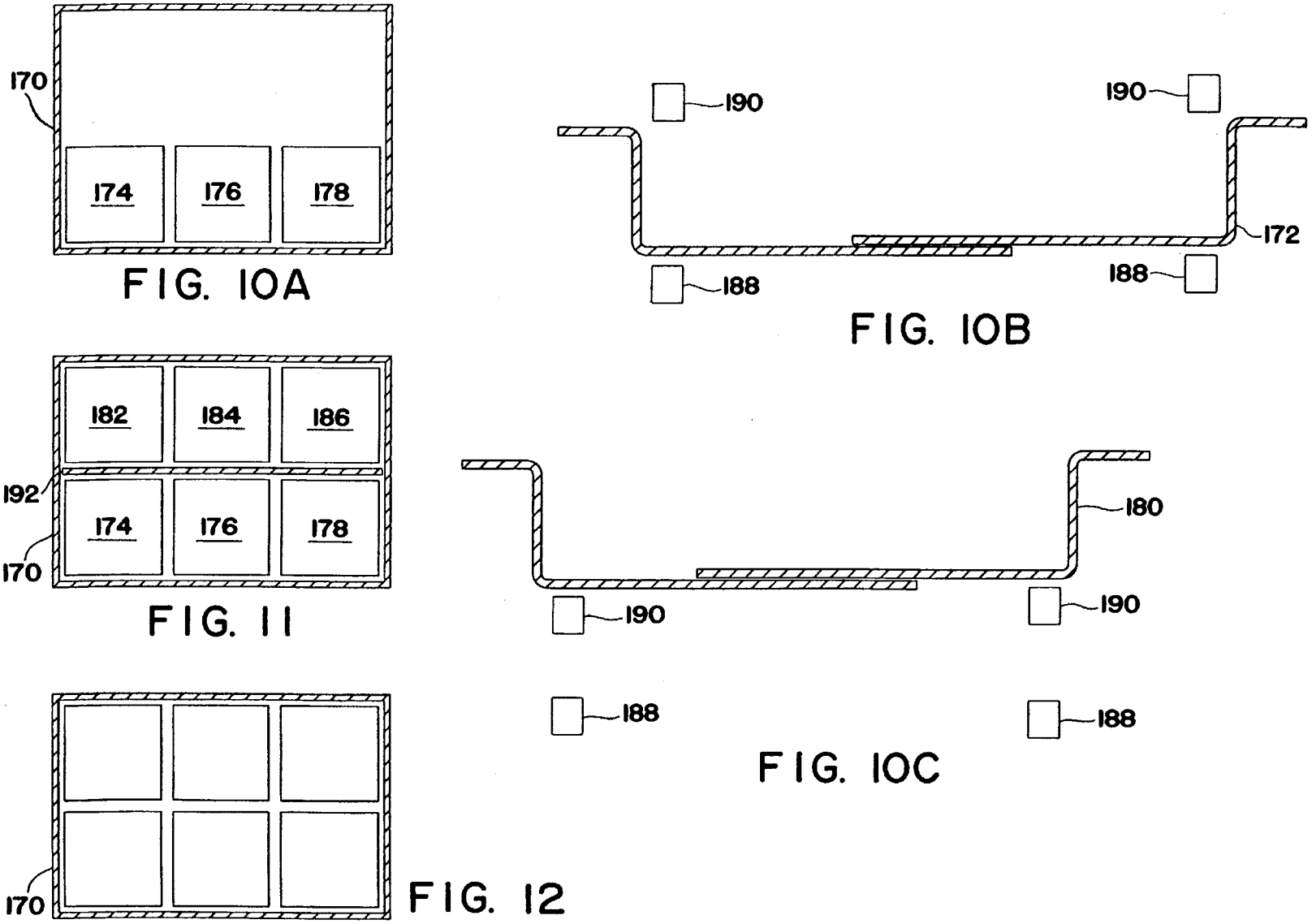
Figure 13:
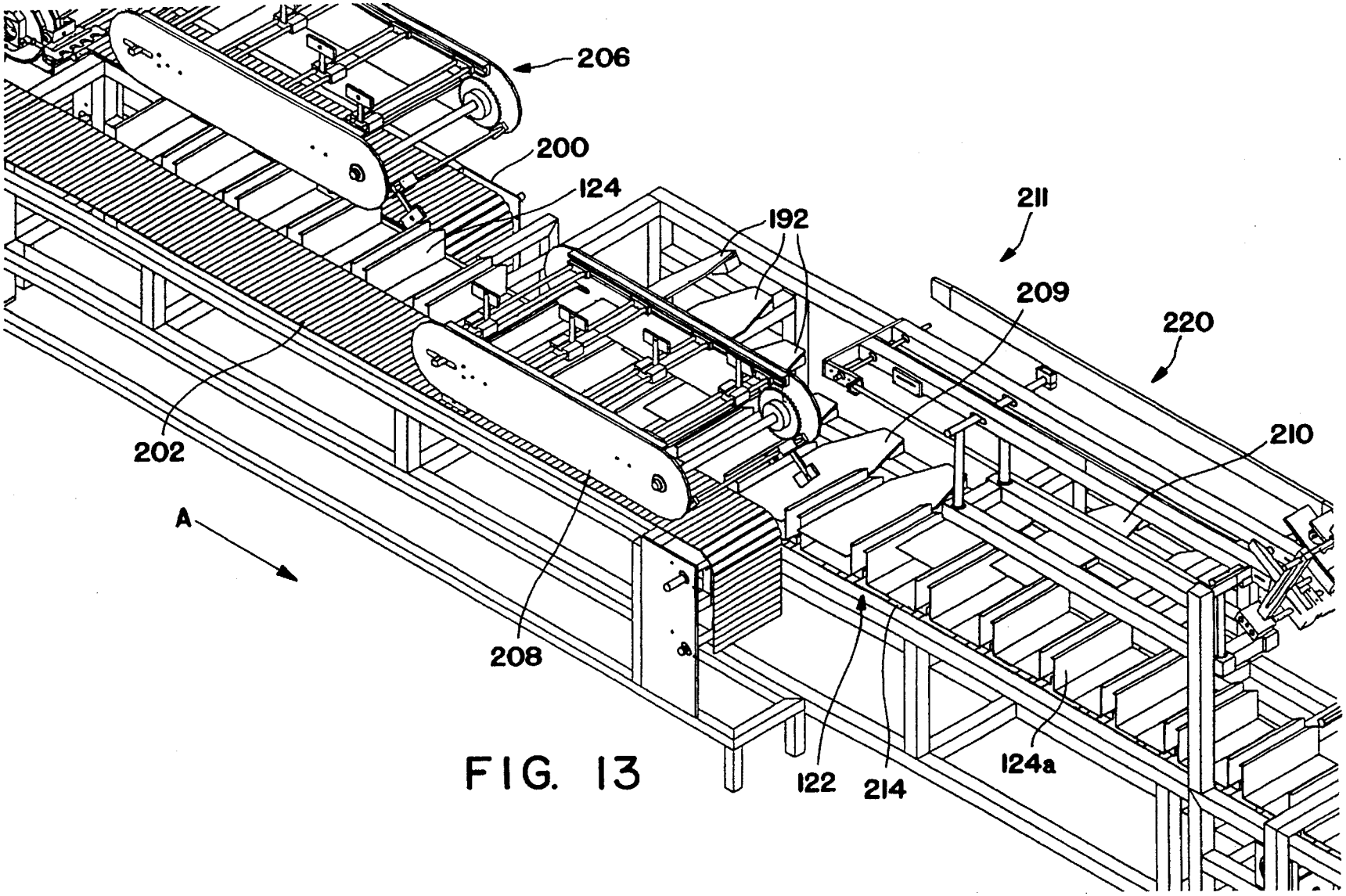

FIG. 3 (taken from U.S. Pat. No. 5,072,573) shows how the irregular shape of the products may make it difficult to align them;

FIG. 4 (taken from U.S. Pat. No. 5,072,573) illustrates how, for the invention, the irregularly shaped product of FIG. 3 may be accommodated to form a single layer without abrasion;

FIGS. 5A and 5B show an inventive slug feeder which incorporates the principles of the invention;

FIG. 6 is an enlarged view of a single space on the meter wheel for receiving a slug;

FIG. 7 is a schematic side elevation of a the slug feeder showing a flow of slugs through the machine of FIGS. 5A, 5B, 6;

FIG. 8 is a perspective view of an automatic packaging machine which may incorporate the present slug feeder invention;

FIG. 9 (taken from U.S. Pat. No. 5,185,984) is a partly schematic, partly exploded view in perspective showing the operation of pushers for moving product from a forwardly thrusted mandrel and into the box and which also illustrates a general principle of how a loading blade may be thrust forward or retracted;

FIG. 9A shows a cam slot illustrating how the packaging machine may be programmed to perform different predetermined tasks;

FIGS. 10A–10C, 11, and 12 are schematic and stop; motion views showing how to load two layers of product into a mandrel or a box without an abrasion of product; and FIG. 13 shows an enlarged section of the machine of FIG. 8 where blades may be used according to the teaching of FIGS. 10–12 to protect a first layer of product while a second layer of product is being installed in a mandrel or box.

FIGS. 1A–1F show six optional configurations of exemplary boxes that may be loaded by the inventive slug packaging system. By way of example, this figure shows six different configurations in which tubes of soda crackers may be packaged in a selected one of several size of boxes. However, it should be understood that the principles described in these figures may be expanded to cover packaging "any suitable" number of slugs in a box.

More particularly, as shown in FIG. 1A, two tubes of crackers 30, 32 are positioned side by side in a single layer within a box 33. In FIG. 1B, the box 37 is twice as high as the box in FIG. 1A so that a second layer of tubes of crackers 34, 36 may be placed over the first layer 38, 40. Likewise, FIGS. 1C and 1E show that the single layer boxes may contain three or four tubes of crackers, respectively. FIGS.

1D and 1F show that by adding a second layer, the boxes may accept six or eight tubes of crackers. Therefore the slug feeder should be able to deliver a selected number of slugs, ranging from two to eight, to a single box of a selected one of many optional sizes.

Figure 2:
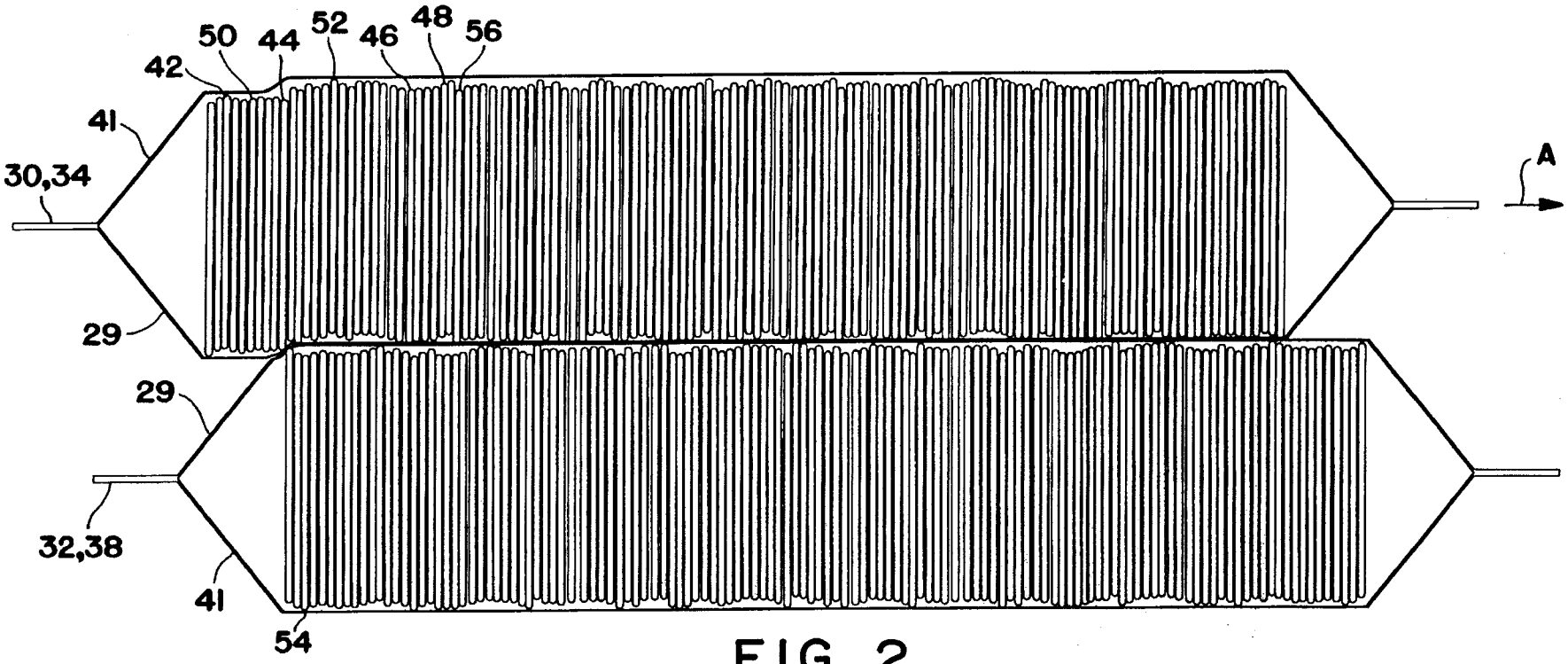
FIG. 2 illustrates how two slugs, such as tubes of crackers, may abrade each other as they are inserted into a box.

FIG. 2 illustrates the problem faced by a feeder of relatively delicate products such as a tube of soda crackers wrapped in wax paper 29. As here shown, there may be two tubes 30, 32 which are inserted side by side in a single layer, such as in FIG. 1A. Or, the two tubes 34, 38 may be vertically stacked, as shown in FIG. 1B, where tube 34 is in an upper layer which is over tube 38 which is in a lower layer.

In FIG. 2, most of the crackers are fairly well aligned. For example, the crackers 42, 44 46 and 48 are in well aligned average positions. However, cracker 50 is displaced in one direction and cracker 52 in an opposite direction relative to the average placed cracker position. As a result, if tube 34 is being pushed in direction A in order to place it next to tube 38, the raised cracker 54 in one layer collides with the lowered cracker 56 in another layer of cracker tubes. This collision knocks flakes off the colliding crackers and causes crumbs and debris which fall out of the tubes, when opened, to the annoyance of the consumer.

As shown in FIGS. 3, 4, the problems related to a horizontal insertion of tubes 30, 32 in a single layer may be solved by a variable width mandrel also shown in FIGS. 5, 6 of U.S. Pat. No. 5,072,573. This patent may be consulted for details on the construction of the mandrel and the control over the width thereof.

The product in the mandrel tray 60 includes three individually wrapped tubes 62, 64, 66 of soda crackers. Owing to the nature of the product, the three tubes do not have a closely controlled cross-section as shown in FIG. 2. The crackers may be misaligned so that each tube is, for example, an eighth of an inch wider than it should be, thus making an accumulated three-eights of an inch of excess width. Also, depending upon where the misaligned crackers are located, there might be a much greater than normal width. The sides of the tubes may be rather irregular so that the same three tubes would not always fit together in the same way. As shown in FIG. 3, the tube of crackers 66 does not fit down and into tray 68, 70.

It will be observed that, in FIG. 3, there is a substantial overlap 72 of the mandrel tray bottoms, which means that the tray is narrow so that the three tubes 62, 64, 66, of crackers must fit almost perfectly if they are to rest in side by side positions. In FIG. 4, the tray 20 has been made much wider (note the small overlap at 72). Thus, there is enough space to receive the tubes of crackers in a side by side relationship with a substantial space 74, 76 between them. As the tray moves from a loading position to a packaging position, the sides 68, 70 may move together to take up the space 74, 76 and make the tubes fit into a box as the tray 60 becomes more narrow.

When the tubes of crackers are stacked vertically, as in FIGS. 1B, 1D, 1F, the first layer (e.g. 38, 40) is installed and then a blade is inserted into a mandrel or box and over that installed layer. Next, the second layer 34, 36 of crackers is pushed over the blade and into the mandrel or box. This way, the two layers of crackers do not come into contact with each other during the insertion of the second. After both layers are installed in the mandrel or box, the blade is withdrawn and the box is sealed. While the invention is here described in terms of upper and lower levels separated by a horizontal blade, it should be understood that other orientations could be used, such as side-by-side columns with a vertical blade separation.

A slug loader 80 incorporating the foregoing principles is shown in FIGS. 5A, 5B, which are substantially the same except for the relative sizes of the parts. This loader is a servo infeed system which is a programmable product handling interface between an upstream supply machine and a downstream packaging machines. The object of this FIG. 5 machine is to assemble incoming product into batches to fulfil packaging machine infeed requirements.

An automatic packaging machine is located on the left hand end (as viewed in the FIG. 5A showing of the slug feeder). A bulk source of product is located on the right hand end of FIG. 5A. The purpose of the loader of FIGS. 5A, 5B is to pick up products from the bulk source (not shown) on the right and to transport them in direction B, delivering them in counted batches to the mandrel of FIGS. 3, 4. The software driven, computer based slug loader system has a programmable logic controller 77 (FIG. 7) connected to servo motor controller 78 which is capable of satisfying many different infeed requirements of a packaging machine. An encoder 79 is a remote sensing device which is used to measure the movement of the output of the slug loader and the input section of the packaging machine. The encoder is used to make the loader insensitive to the variation of speed of the associated machines, which is far superior to other solutions involving attempts to simultaneously run various machines in a time synchronism. Also, the programming flexibility make this approach attractive for many applications.

Three separate conveyor belts 82, 84, 86 (FIG. 5A) are placed in a series so that the product flows from a source on the right to a packaging machine on the left. Each of these conveyor is preferably a relative wide rubber belt. The first conveyor belt 82 travels faster than the second conveyor belt 84, and it, in turn, travels faster than the third belt 86. This means that if the products are scattered on the first conveyor belt 82, they will be brought together in a more or less compact relationship with a desired product density by the time that they reach a stationary table 88. Thus, the tubes of soda crackers, for example, will be in virtually side by side contact with each other when they are pushed onto table 88.

Along the series of conveyors, a number of detectors D1–D11 detect the passage of the products and momentarily stop the conveyors (as required) if the products are not flowing smoothly. Preferably, each of the detectors is a combination of a light emitting diode and a photo electric cell. As the detectors find that a downstream conveyor is becoming congested, the conveyors stop bringing in new products in order to loosen the accumulating product density. Then, after the traffic jam clears, the upstream conveyors resume their operation.

Further, the surface texture 90 of the upstream conveyors 82, 84 tends to be a little rougher to more or less ensure movement of the product. The surface of the downstream conveyor 86 is smoother so that the conveyor belt may tend to slip under a relatively compact accumulation of product to assure the desired product density. The table 88 has a relatively smooth, almost friction free surface so that the product slides easily into a pick up position.

A metering wheel 92 is positioned to pick up the tubes of crackers one-by-one as they appear on the output end of the table 88. The metering wheel 92 includes two or more spaced parallel disks, each having peripheral "teeth" such as 94, 96 defining recesses which correspond to two sides of the cross section of a tube of crackers 30. Thus, as shown in FIG. 6, a tube of crackers 30 has been picked up in the space between teeth 94, 96 and is being carried to a metering belt 98 down stream of the wheel 92.

The invention contemplates a plurality of disk having different peripheral toothed contours. Thus, for example, teeth 94, 96 (FIG. 6) are separated by a distance appropriate for picking up tubes of soda crackers. If the product is something else with a different cross section, either new disks 92 or a different ring will be installed in the slug feeder. For example, in FIG. 6, two bolts 99 may be removed and a ring having teeth 94, 96 may be removed from disk 92. Another ring, with a different profile, is installed on disk 92 and bolts 99 are returned to hold it in position.

A photo cell or other suitable detector 100 detects the presence of the picked up tube of crackers. Therefore, a counter may accurately count the tubes of crackers delivered at the output of the meter wheel even if, for any reason, one or more of the tubes of crackers are missing from the metering wheel.

The metering belt 98 has a plurality of up standing fences 102, 104 mounted thereon to define a receiving area 106 (FIG. 5B) between them. Each batch of product is delivered into an area 106 between adjacent fences. Therefore, the motion of belt 98 may be adjusted to receive batches containing a selected number of products which are accumulated with any suitable count, per batch. Then, the metering belt moves on one step and present the next succeeding area to receive the next batch of product. For example, if the box awaiting the crackers is configured as shown in FIGS. 1A, 1B, two tubes of crackers 108, 110 (FIG. 7) are deposited in the area 106 between fences 102, 104. If configured as shown in FIGS. 1C–1F, three or four tubes are deposited in each area between the fences on the meter belt 98.

The loader (FIG. 7) includes independent drive control motors 112, 114. Motor 112 is controlled by a variable frequency drive circuit 116 under the direction of the various sensors D1–D11 (FIGS. 5A, 5B) so that the loading operation may be closely controlled. Thus, a microprocessor may control all of the loading operations. The loading parameters may be set into the microprocessor, and then in drive circuit 116 while the loader continues in operation. For example, the automatic packaging machine may be initially set to put two tubes of crackers in area 106 in order to fill a box configured as in FIGS. 1A or 1B. Then, without stopping the loader, it may be reprogrammed to put three tubes in area 106 for the boxes of FIGS. 1C, 1D or four tubes for the boxes of FIGS. 1E, 1F.

Whenever the loader stops, it is always stopped at the same initial position. Likewise, the various detectors and circuits operating responsive thereto are always set to respond uniformly to either a leading or a trailing edge of the product. The stopping of the loader for a lack of product is always delayed until the arrival of a point in the delivery cycle where the lack of that product is material to the required delivery. All of these and similar programming rules are calculated to eliminate the need for reinitializing or coordinating the various machines when loading restarts.

In most cases, the programmable logic control circuit 77 (FIG. 7) is used to process all of the loader control inputs, especially in response to sensor signals. (While FIG. 7 shows only two sensors D10, D11, it should be understood that any number of sensors may be connected to controller 77.) Also, circuit 77 controls the various conveyors and delivers all control signals to the servo motor controller 78. Nevertheless, in some cases when rapid product handling is required, the scan time of circuit 77 could cause the accuracy of response time of the loader to deteriorate. In such a case, the outputs of position sensors D1–D11 may feed directly into servo motor controller 78.

The encoder 79 is responsible for coordinating and following an operational procedure according to the needs and speed of a downstream automatic packaging machine which is mechanically coupled to the loader with or without a gear box, depending on the application requirements.

Together the circuits 77, 78 perform a number of operations which control and coordinate the various parts of the system. Among other things these operations include an initial position adjustment of the product handling metering wheel 92, which uses all of the possible machine speeds as a reference; provide both "upstream" and "downstream" machine interaction (bi-directional handshaking); and start/stop (including emergency stop) handling with output signals. The control logic inside circuit 77 is programmed according to the requirements of associated upstream and downstream machines. Variable speed drives control motors 112, 114, accompanied with on/off control of the conveyers 82, 84, 86 in order to provide for a wide variety of packaging requirements. The in-fly parameter change facility may be programmed and reprogrammed according to the infeed process demands without stopping the machine.

FIG. 8 is a perspective view of a packaging machine 120, of a type that may utilize the teachings of the present invention. One or two (here two) of the inventive loaders are located at 98 to feed product into the mandrels, each of which is the same as the mandrels of FIGS. 3, 4.

The machine 120 includes an elongated conveyor 122 carrying adjustable width product mandrels 124 (FIGS. 3, 4) past a plurality of work stations, one having a thruster section 126 where the mandrels 124 may be thrust forwardly (as shown in FIG. 9) into a juxtaposed relationship with respect to confronting boxes 150. The conveyor 122 (FIG. 8) carries the mandrels 124 through a loader area 130 where they pick up products from a metering wheel 92*a*, or 92*b*. In this case, the product may be the tubes of crackers 30–40 (FIGS. 1A–1F) which are carried forward to the area 126 where the product is loaded into boxes. A pusher rod, such as 134, pushes the product from a forwardly thrust mandrel into a box.

The machine may also include any other work stations having suitable modules such as a carton or box feeder 135 (most of which is omitted in an interest of showing the underlying machine), a glue unit (not shown), a power drive units 138, discharge units 140, and miscellaneous system controls and adjustment means. A cam slot 151 (FIG. 9A) programs delivery by engaging each mandrel as it passes a loading station or thrust area and causes the mandrel to move outwardly toward the boxes (as shown it 152, 154) to a loading position.

FIG. 9 shows a plurality of mandrels 124 (also shown in FIGS. 3, 4) in various width dispositions. A product can be properly shaped and located by being conditioned by an inward movement (or by repeated cycles of inward and outward movements) of the upright sides 68, 70 as programmed by a cam slot (FIG. 9A), until the opposite sides are spaced apart by a distance which is complimentary to the lateral inside limits of the box. When properly positioned, the front end of this mandrel may be thrust forward and be fitted into and encompassed by the open end of the box, as show at 150 (FIG. 9).

Another conveyor 156 carries a number of pushers (such as 134), each having a cam follower 158 thereon. These cam followers ride in slot 159 extending parallel to a path followed by the mandrels 124. At a proper location relative to mandrels 124, the slot is inclined toward the box thereby moving a cam follower 158 to cause a pusher to move, as cam follower 158*a* is causing pusher 160 to enter the confronting mandrel 162 and to begin urging the product into the confronting box. At 164, the pusher has thrust the product completely into the confronting box 150 under the urging of cam follower 158*b*. At 166, the cam follower 158*c* is withdrawing the pusher from the confronting box. At 168, the pusher is completely withdrawn from the mandrel.

FIGS. 10–12 schematically show the principle of how two layers of product may be inserted into a single mandrel or a box 170 without abrasion of products in one layer against products in the other layer. This particular box 170 is drawn, by way of example, to illustrate the box also shown in FIG. 1D. However, it should be understood that a box of any suitable size may be loaded in the same manner.

In FIGS. 10A, 10B and 10C schematically, the upper and lower conveyors 188, 190 are here shown above each other. The mandrel 172 (FIG. 10B) which transports the lower layer of product 174, 176, 178 (FIG. 10A) is schematically shown as at the level of the bottom interior of box 170. The mandrel 180 (FIG. 10C) which transports the upper layer of product (FIG. 11) is schematically shown at the level of the upper layer of product 182, 184, 186. After the lower level of crackers is installed, the conveyor link chain might be designed to move from the lower level position of mandrel 172 to the upper level of mandrel 180.

However, in the preferred embodiment, two separate conveyor chains 188, 190 are provided with a lower conveyor chain 188 carrying the mandrel 172 and an upper conveyor 190 carrying the mandrel 180. The two conveyors may also be arranged in either parallel or series. Also, as will become more apparent, a preferred embodiment loads the two layers in a mandrel and then the stacked layers are pushed simultaneously into a box.

With these principles in mind, the actual machinery for accomplishing the loading will become more apparent from a study of FIGS. 8 and 13.

FIG. 13, which shows the preferred embodiment of the invention, is an enlarged portion of FIG. 8

One loader conveyor 200 is positioned at a level which is lower than the level of the other loader 202. Each loader conveyor has its own upstream metering wheel 92*a*, 92*b* (FIG. 8) and an associated input conveyor. A mandrel conveyor 122, carrying the mandrels 124, is located between the loader conveyors 200, 202. Two over head pusher units 206,208 are located above individually associated one of the loader conveyors 200, 202. The pusher unit 206 associated with the lower loader conveyor 200, is located upstream of the pusher 208 associated with the higher loader conveyor 202.

The blade unit 211 has a plurality of thin metal blades (such as 209) connected to a blade conveyor 214. Each blade 212 has an attached cam follower which rides in a slot extending parallel to a path followed by the conveyor 214, similar to the showing of FIG. 9. At a proper location relative to the mandrels, the underlying slot is inclined toward the mandrel conveyor 122 thereby moving the cam follower and causing a blade to enter the confronting mandrel 124 and over the previously installed lower level of product so that two levels of product will not abrade each other when the upper level is slid over the lower level. At 220, the slot inclines away from the mandrel conveyor 122 and thereby moves the cam follower to withdraw the blade from the confronting mandrel.

Product on the lower loader 200 is pushed by the pusher unit 206 onto the confronting mandrel. As the mandrel moves along the mandrel conveyor 122 toward the upper pusher unit 208, blade unit 209 extends a horizontal into the mandrel tray and over the lower layer of product. When the mandrel reaches the position opposite the upper pusher unit 208, it pushes product into the mandrel tray 15 on top of the blade which separates the two levels of stacked product. As the mandrel moves farther along the mandrel conveyor 122, the blade is withdrawn.

In operation, this machine is fed by two metering wheels 92*a*, 92*b* supplying two parallel positioned loader conveyors 200, 202 20 which are side by side. The loader conveyors 200 carries product at a lower level which becomes a layer of product in a lower level of a two level box (FIGS. 1B, 1D, 1F) or the only level, when there is but one level in the box (FIGS. 1A, 1C, 1E). The other conveyor 202 carries the product at the level which becomes the upper layer of product (FIGS. 1B, 1D, 1F). The two layers of product may be laid one on the other in the mandrel 204 and then both layers may be pushed simultaneously into one end of the box.

Hence, the mandrels 124 first receive the lower layer of crackers which are pushed from conveyor 200 by an overhead pusher system 208 (constructed as shown in FIG. 9). Then, farther down the line, another pusher system inserts the blades 192 (as at 209) over the lower layer of crackers in the mandrel 124. Next, the other and upper layer conveyor 202 inserts the upper layer of crackers into the mandrel 124 sliding over the blade 192. Finally, the conveyor withdraws the blade 192 (as at 210).

Thus, at the location 211, the loaded mandrel 124*a* (for example) is carrying two levels of product. When the loaded mandrel 124*a* reaches work station 126 (FIG. 8), the stacked products are pushed into the box by a pusher 134. This way, there is no abrading of product on one level which might otherwise be caused by the sliding of the product of one layer over the other layer.

Those who are skilled in the art will readily perceive how to modify the invention. Therefore, the appended claims are to be construed to cover all equivalent structures which fall within the true scope and spirit of the invention.

The claimed invention is:

1. An automatic packaging machine for sliding a plurality of product side by side into a box, said machine comprising a metering wheel, a plurality of teeth uniformly formed around the entire periphery of said metering wheel, said teeth defining product receiving areas between them, means upstream of said metering wheel for delivering product to said metering wheel with a product density such that an individual product fits into each of said receiving areas defined by said teeth on said metering wheel, said upstream delivery means comprising a series of conveyor belts extending from a source of product toward said metering wheel, metering belt means downstream of said metering wheel for receiving directly from said metering wheel said plurality of product as delivered by said metering wheel, accumulating means operated independently of the size and shape of the product and responsive to the delivery of product directly from said metering wheel for grouping said plurality of said product on said metering belt means into batches, each batch having any selected one of several number of said product, and mandrel means for receiving said batch of said products directly from said product accumulating means and for carrying said received products directly to a container, said mandrel means having a variable width which gently moves said predetermined number of products together by enlarging said mandrel means at least once to receive said product and then reducing said width at least once to move said products together to fit into said container;

means for carrying a plurality of said mandrel means at different levels relative to said container in order to insert the product in said mandrel means into said container at different levels to provide multi-layers of product inside said container;

and means for positioning a blade between said layers during an interval while product is being installed in said container, said insertion blade traveling into said container along with said product and withdrawing from said container after said product is inserted whereby vertically displaced layers do not abrade each other while actually being installed in said container.

2. The machine of claim 1 and means for operating each successive conveyor belt in said series at a slower speed so that said products are brought together and into said product density at the end of the conveyor belt nearest said metering wheel.

3. The machine of claim 1 wherein said conveyor belts have surfaces such that said conveyor belts nearest said source of product have surfaces which are rougher than surface of belts nearest said metering wheel.

4. The machine of claim 3 and a smooth stationary surface extending between an output end of said series of conveyor belts and said metering wheel, said products pushing each other along said smooth stationary surface and into alignment when they arrive at said metering wheel.

5. The machine of claim 1 wherein said metering belt means comprises a belt with a plurality of upstanding fences periodically located thereon, a space between each of two adjacent ones of said fences defining between them a product a cumulation area, programmable logic means for counting products delivered into said product a cumulation areas by said metering wheel, and means responsive a selected product count for periodically moving said metering belt to cause a number of said products selected by said logic means to be in each batch of said product.

6. The machine of claim 1 wherein the width of said mandrel means is cyclically and repeatedly enlarged and reduced to condition a product within said mandrel.

7. An automatic packaging machine for loading a plurality of products by sliding them side by side into a container, said products having a characteristic such that said plurality of products would abrade each other if slid side by side into said container without due care, said automatic packaging machine comprising metering wheel means having a profile with spaces for picking up said products one at a time at an input position and transporting said picked up products one at a time to an output position, means for delivering said products from a source to an input of said metering wheel means with a predetermined product density, a multi-position accumulating belt means at an output of said metering means for sequentially accumulating said products on said belt into batches having a preselected count, said batches inherently forcing said products to slide side by side adjacent each other when inserted into a container, programmable logic means for selecting a number in said preselected count by depositing one batch into each of said positions on said accumulation belt means, insertion means fitting between product for sequentially and gently inserting a batch of said products by sliding them one at a time into a side by side configuration within a container without abrading one product against another product in said batch during said sliding insertion, means for withdrawing said insertion means from between said product after said insertion is complete;

said insertion means comprising a variable width mandrel, control means for making said mandrel wider at least once to accept a batch of said products and thereafter narrower at least once to bring said product into a layer with close association and without an undue amount of abrasion between said products in said layer, and blade means for insertion between layers of said products during an insertion of one layer of products which must slide over another layer of said products, said blade means entering said container with the product and withdrawing from the container after the product is in place within the container.

8. The machine of claim 7 wherein said metering wheel means profile has uniform spaces uniformly distributed around the periphery thereof, each of said spaces defining a plurality of pick-up areas in each of which one of said products may rest after it is picked up at said input position and while it is being delivered to said output position, and said multi-position accumulating means is an endless conveyor belt having a plurality of upstanding fences thereon for defining spaces between said fences, each of the spaces between said fences being one of said multi-positions defining an area for collecting a batch of said products, and means for moving said endless conveyor belt a distance equal to one of said batch collecting areas in response to said delivery of a number of said products equal to a batch of said products.

9. The machine of claim 7 wherein said metering wheel profile is formed on a perimeter of a replaceable ring whereby differently shaped products may be accommodated by replacing a ring of one profile with another ring having a different profile.

10. The machine of claim 7 and means for programming said control means for repeatedly making said mandrel wider or narrower in order to condition product.

11. The machine of claim 7 wherein said product comprises tubes of crackers wrapped in wax paper; and said container comprises a box selected from a group consisting of: one level boxes having shapes and sizes for receiving a single layer of two, three, or four of said tubes in a side-by-side configuration; and two level boxes having shapes and sizes for receiving two layers, each of said layers having two,three, or four of said tubes in a side- by-side configuration.

12. The machine of claim 7 wherein said profile on said metering wheel comprises a plurality of pickup spaces on said metering wheel defining a plurality of spaces, each of said spaces being shaped to conform to adjacent sides of the cross section of one of said products, and said accumulating belt means is an endless conveyor belt having a plurality of upstanding fences thereon defining batch spaces between them, each of said batch spaces between said fences defining a batch collecting area which is wide enough to receive at least four of said products, and means for moving said endless conveyor belt with fences a distance equal to one of said batch spaces in response to a delivery to said output position of a number of said products equal to a batch of said products.

* * * * *